US009103244B2

(12) United States Patent
Elendt et al.

(10) Patent No.: US 9,103,244 B2
(45) Date of Patent: Aug. 11, 2015

(54) ACTUATOR DEVICE FOR THE ADJUSTMENT OF A SLIDING CAM SYSTEM WITH SWITCHING DISK

(71) Applicants: Harald Elendt, Altendorf (DE); Andreas Nendel, Hessdorf (DE); Christoph Glaess, Nuremberg (DE)

(72) Inventors: Harald Elendt, Altendorf (DE); Andreas Nendel, Hessdorf (DE); Christoph Glaess, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 223 days.

(21) Appl. No.: 13/621,870

(22) Filed: Sep. 18, 2012

(65) Prior Publication Data

US 2013/0118427 A1 May 16, 2013

(51) Int. Cl.

| | |
|---|---|
| ***H01F 7/08*** | (2006.01) |
| ***F01L 13/00*** | (2006.01) |
| ***H01F 7/16*** | (2006.01) |

(52) U.S. Cl.

CPC ..... *F01L 13/0036* (2013.01); *H01F 7/1607* (2013.01)

(58) Field of Classification Search

CPC ..... H01F 7/1607; F01L 13/0036

USPC ..... 335/220–229, 253; 123/90.17, 90.18, 123/90.15

See application file for complete search history.

(56) References Cited

U.S. PATENT DOCUMENTS

| | | | | |
|---|---|---|---|---|
| 6,966,291 | B1 * | 11/2005 | Fischer et al. | 123/90.39 |
| 7,125,058 | B2 * | 10/2006 | Hawthorne | 294/82.28 |
| 8,596,237 | B2 * | 12/2013 | Popp et al. | 123/90.18 |
| 8,616,167 | B2 * | 12/2013 | Nendel | 123/90.18 |
| 8,813,699 | B2 * | 8/2014 | McConville et al. | 123/90.16 |
| 2011/0240892 | A1 * | 10/2011 | Nendel | 251/129.01 |
| 2013/0087113 | A1 * | 4/2013 | Gunnel | 123/90.17 |
| 2013/0293035 | A1 * | 11/2013 | Elendt | 310/12.32 |

FOREIGN PATENT DOCUMENTS

| | | |
|---|---|---|
| DE | 102006051809 | 5/2008 |
| DE | 102007024598 | 11/2008 |
| DE | 102007024600 | 11/2008 |
| DE | 102008020892 | 10/2009 |
| DE | 102008020893 | 10/2009 |
| DE | 202009015468 | 4/2010 |
| DE | 102008060166 | 6/2010 |
| DE | 102009053121 | 5/2011 |
| DE | 102010048005 | 4/2012 |
| WO | 2010097298 | 9/2010 |

* cited by examiner

*Primary Examiner* — Bernard Rojas

(74) *Attorney, Agent, or Firm* — Volpe and Koenig, P.C.

(57) ABSTRACT

Actuator device of a sliding cam system with at least one sliding cam and with at least one actuator pin (13) projecting from the housing. The housing is attachable to a component of a cylinder head or to the cylinder head of an internal combustion engine and the actuator pin(s) (13) can contact at least one groove of a sliding cam system that has at least one ejection ramp. The actuator pin(s) (13) are loaded in the direction toward the sliding cam by springs (14) and can be fixed in their retracted position facing away from the groove by a latching device that can be locked and is controlled by an electromagnet unit. At least one latch element (11) of the latching device is in active connection with at least one recess (12) on the actuator pin(s) (13).

9 Claims, 2 Drawing Sheets

ACTUATOR DEVICE FOR THE ADJUSTMENT OF A SLIDING CAM SYSTEM WITH SWITCHING DISK

CROSS-REFERENCE TO RELATED APPLICATIONS

This application claims the benefit of German Patent Application No. 102011086233.1, filed Nov. 14, 2011, which is incorporated herein by reference as if fully set forth.

FIELD OF THE INVENTION

An actuator device of a sliding cam system with at least one sliding cam and with at least one actuator pin projecting from a housing, wherein the housing can be attached to a component of a cylinder head or to the cylinder head of an internal combustion engine and the actuator pin(s) can contact at least one groove of a sliding cam system that has at least one ejection ramp and wherein the actuator pin(s) are loaded by springs in the direction toward the sliding cam and can be fixed in their retracted position set apart from the groove by a latching device that can be locked and is controlled by an electromagnetic unit.

BACKGROUND

Such an actuator device is known from WO 2010/097298 A1. In this actuator device, the actuator pins have a hollow construction and have latch elements in openings of their walls, wherein these latch elements are in active connection, on one side, with an external component and can be locked, on the other side, by conical pins. Although the outer component has a conical surface corresponding to the latch elements, the locking is based on the clamping effect of the latch elements.

Apart from the fact that this actuator unit has many individual parts, requires a high installation effort, and generates high production costs, there is the problem that, e.g., due to vibrations of the internal combustion engine and thus of the actuator device, the latching device is not always securely locked and also not always released after locking, so that the actuator pins are lowered in an undesired way in the direction of the sliding cam unit, causing an undesired contact between the sliding cam and the groove.

SUMMARY

The present invention is therefore based on the objective of improving an actuator device of the type named above, so that the mentioned disadvantages are eliminated. A high ejection speed for insertion into the displacement groove should be guaranteed and also the actuation of two actuator pins should take place without reversing the poles of the current direction on the magnetic core of the electromagnetic unit. Furthermore, a small number of components should be used for reducing the installation and production costs and thus a cost-effective production should be possible. In addition, for the purpose of tolerance compensation, an active return stroke of the actuator pins should be provided.

This objective is met in that at least one latch element of the latching device is in active connection with at least one recess on the actuator pin or a component connected to the actuator pin. Thus, a clear fixing of the actuator pin or pins in the latching device is guaranteed, so that the actuator pins are led into the recess, locked rigidly in their retracted position, and are not ejected in an undesired way even if there are vibrations of the internal combustion engine.

The latch element(s) that are advantageously formed as balls are guided so that they can move in a switching disk in the radial direction relative to the actuator pin(s) and are fixed in the direction perpendicular thereto.

Here, the latch element(s) are also in active connection with a component that has, on one side, a support surface that is set apart corresponding to the dimension of the latch element from the base of the recess and thus supports the latch elements in the recess and that has, on the other side, an undercut whose depth is set apart corresponding to the dimension of the latch element from the outer lateral surface of the actuator pins. Through this construction it is guaranteed that the latch element(s) can move in the radial direction between the recess on the actuator pin(s) and the undercut, so that the actuator pins can move freely in the plane between the recess(es) and the undercut, while the actuator pins are locked when the latch element(s) are in active connection with the support surface and therefore cannot deform in the radial direction. However, the latch elements are here in active connection with the recess or the edge of the recess and clearly fix the actuator pins.

The position of the undercut and/or the recess and/or the position of the latch elements in the switching disk are selected in the axial direction of the actuator pins so that the latch elements contact the recesses and the support surface in the retracted position of the actuator pins.

According to the invention, the switching disk is connected to at least one transmission pin that can be displaced by the electromagnetic unit against the force of a compression spring in the direction toward the sliding cam. By energizing the electromagnet, the transmission pins displace the switching cam against the force of the compression spring so far that the latch elements can come into active connection with the undercut and thus can release the actuator pins. Conversely, in the retracted position, the compression springs ensure that the latch elements contact the support surface and are in active connection with the recesses or their edge, so that the actuator pins are completely retracted and are held in the retracted position.

The transmission pin(s) are controlled by a magnetic core of the electromagnetic unit that is arranged within a magnetic coil, advantageously with the intermediate placement of a guide knob.

Here, the pressure magnitude of the compression springs is greater than the forces of the springs of the actuator pins, so that the compression springs move the actuator pins against the force of their springs for movement into the inner position and can be held there. Advantageously, two actuator pins are provided with springs whose plane is oriented parallel to the axis of the sliding cam, wherein two transmission pins arranged parallel thereto are provided with compression springs whose plane is rotated relative to the plane of the actuator pins advantageously by 90°.

The actuator pins and transmission pins, including the switching cam, are supported in a guide sleeve, wherein the guide sleeve is fixed on a flange. The flange is used on its side for fastening the actuator unit on the component of the cylinder head or on the cylinder head itself and simultaneously acts as an abutment for the springs for the travel of the actuator pins.

On the side of the flange turned away from the guide sleeve, the magnetic core connects to the guide knob and magnetic coil that are held in an outer housing. A terminal disk is provided on the side of the magnetic coil turned away from the flange.

BRIEF DESCRIPTION OF THE DRAWINGS

For the further explanation of the invention, reference will be made to the drawings in which an embodiment of the invention is shown in a simplified form.

Shown are.

DETAILED DESCRIPTION OF THE PREFERRED EMBODIMENTS

Figure 2:
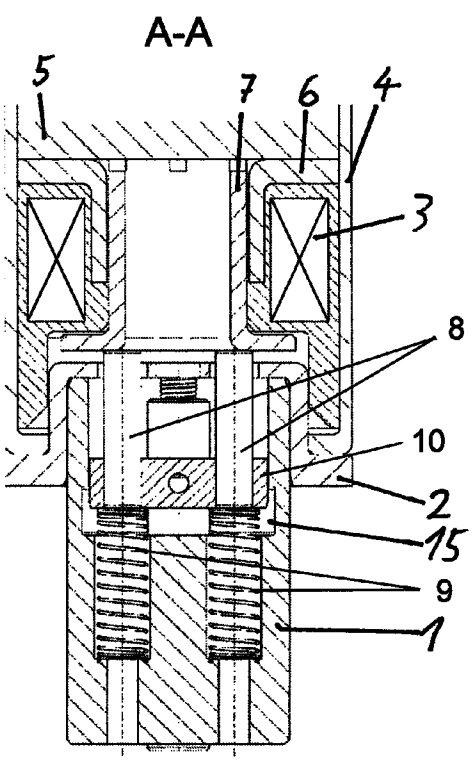
FIG. 2 is a section view through the actuator device with a view of the transmission pins according to the line A-A in FIG. 1.
Figure 1:
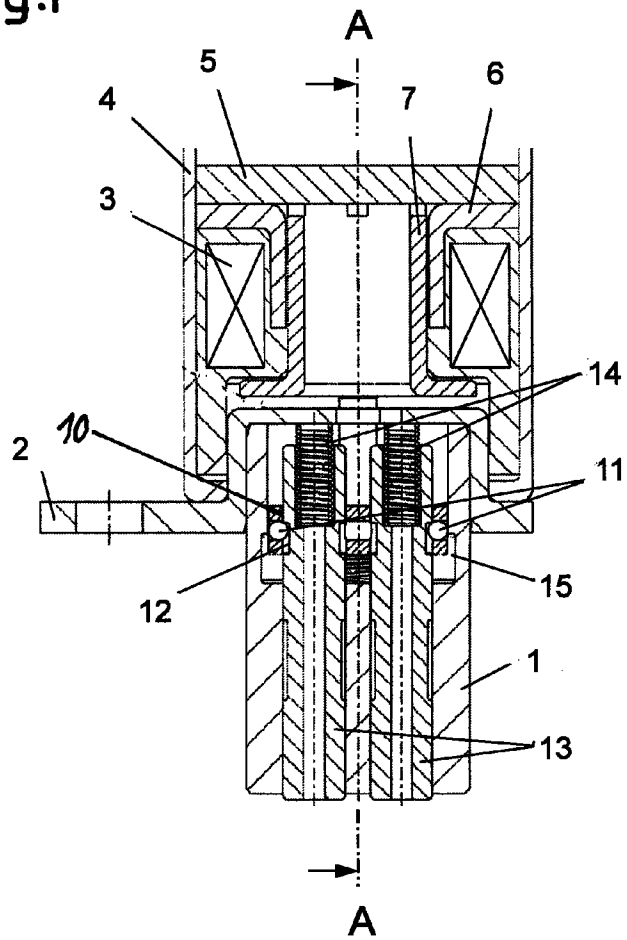
FIG. 1 is a section view through an actuator device with retracted actuator pins.
Figure 4:
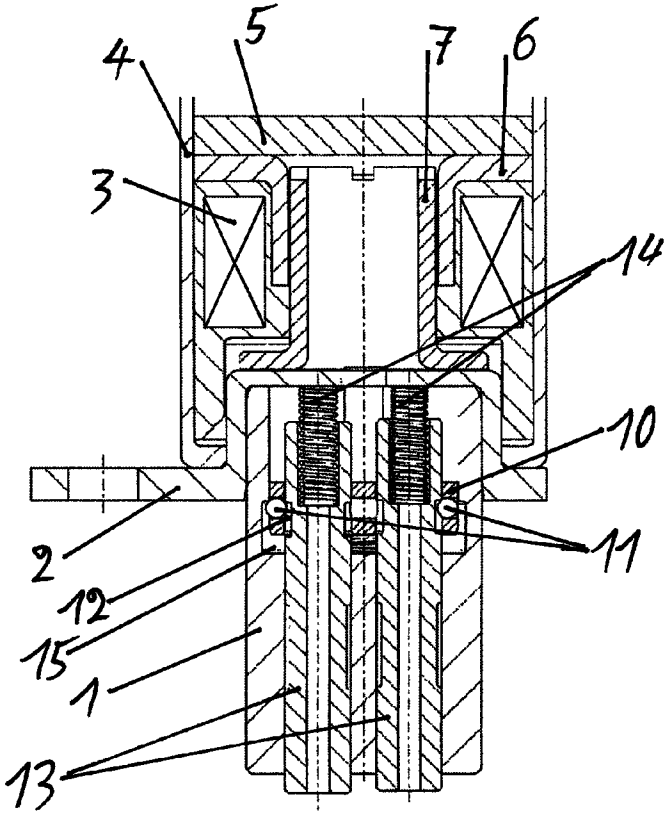
FIG. 4 is a section view corresponding to FIG. 1 with a non-energized electromagnetic unit.
Figure 3:
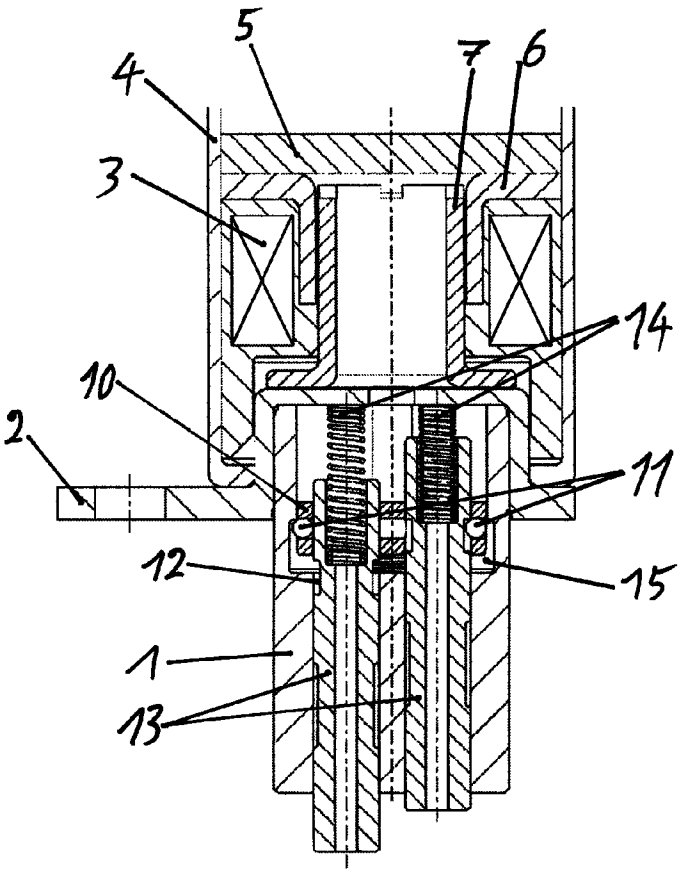
FIG. 3 is a section view corresponding to FIG. 1 with an energized electromagnetic unit.

In FIGS. 1 to 4, as far as shown in detail, 1 designates a guide sleeve that is supported in a borehole of a component of the cylinder head or the cylinder head (not shown). The guide sleeve 1 is attached to a flange 2 that can be screwed with the component or the cylinder head. A magnetic coil 3 that is arranged in an outer housing 4 is provided on the side of the flange 2 turned away from the guide sleeve 1. This outer housing is attached to the flange 2. A terminal disk 5 and a guide knob 6 are arranged and attached outside of the magnetic coil 3 in the outer housing 4. Within the guide knob 6 and the magnetic coil 3, a magnetic core 7 is installed that can be displaced in the axial direction within the magnetic coil 3 and the guide knob 6 and is controlled by the magnetic coil 3. The magnetic core 7 has a flange and is in active connection with this flange with transmission pins 8 (see FIG. 2) that are supported on the other side on the guide sleeve 1 by compression springs 9. The transmission pins 8 are connected rigidly to a switching disk 10. The switching desk 10 has radial openings in which latch elements 11 are guided. Openings in which actuator pins 13 are held are provided in the switching disk 10 parallel to the transmission pins 8. The actuator pins 13 have recesses 12 that can come into active connection with the latch elements 11. The actuator pins 13 are loaded by springs 14 that are supported on the flange 2 and load the actuator pins in the direction (ejection direction) toward the sliding cam. An undercut 15 is provided in the guide sleeve 1 at least partially adjacent to the recesses 12, so that the latch elements 11 can move freely in the radial direction at the height of the undercut 15 and can release the actuator pins 13.

If the latch elements 11 are located next to the undercut 15 on a support surface on the guide sleeve 1, then the radial distance between the recess 12 and the support surface is so small that the latch elements 11 remain in the recesses 12 and fix the actuator pins 13.

The springs 14 and compression springs 9 are designed so that the force level of the compression springs 9 is greater than the forces of the springs 14 for ejecting the actuator pins 13. Because the friction on the latch elements 11 also acts against the ejection movement of the actuator pins 13, the actuator pins 13 are moved back into the retracted position when the magnetic coil 3 is not energized and remain there.

If the magnetic coil 3 is energized, then the magnetic core 7 pushes the transmission pins 8 in the direction toward the guide sleeve 1 against the force of the compression springs 9. Therefore the switching disk 10 and thus the catch elements 11 are displaced from the area of the support surface into the area of the undercut 15, so that the actuator pins 13 are released by the catch elements 11, because these can be released from the recesses 12. The springs 14 then move the actuator pins 13 in the direction of the sliding cams. One of the actuator pins 13 can engage in a matching groove and can displace the associated sliding cams from one to a different actuation element of the gas-exchange valves. The other actuator pins 13 moves outward up to the outer lateral surface of the sliding cam that is also designated as the high circle of the sliding cam.

After the displacement process, the actuator pin 13 mentioned first is moved out from the groove by the ejection ramp. The ejection ramp pushes this actuator pin backward at least up to the high circle of the sliding cam. In this position, the catch elements 11 can now move into the recesses 12 of the actuator pins 13 and be supported on the support surface or the edge of the support surface of the guide sleeve 1. Through the force of the compression springs 9 that is greater than the force of the springs 14, these push the actuator pins 13 a sufficient distance that is approximately 1 mm relative to the high circle of the sliding cam. The second actuator pin is here likewise retracted into the starting position by the switching cam 10 and the compression spring 9.

LIST OF REFERENCE NUMBERS

1 Guide sleeve
2 Flange
3 Magnetic coil
4 Outer housing
5 Terminal disk
6 Guide knob
7 Magnetic core
8 Transmission pin
9 Compression springs
10 Switching disk
11 Latch elements
12 Recesses
13 Actuator pins
14 Springs
15 Undercut

The invention claimed is:

1. An actuator device of a sliding cam system, the actuator device comprising at least one actuator pin projecting from a housing, the housing is adapted to be attached to a component of a cylinder head or to the cylinder head of an internal combustion engine and the at least one actuator pin is controlled by an electromagnetic unit and is loaded in an extension direction by a spring and is fixed in a retracted position opposite from the extension direction by a latching device and at least one latch element of the latching device is movable into active connection with at least one recess on the at least one actuator pin for locking the actuator pin in position.

2. The actuator device according to claim 1, wherein the latch element comprises a ball that is guided for movement in a switching disk in a radial direction relative to the actuator pin and is fixed in a direction perpendicular thereto.

3. An actuator device of a sliding cam system, the actuator device comprising at least one actuator pin projecting from a housing, the housing is adapted to be attached to a component of a cylinder head or to the cylinder head of an internal combustion engine and the at least one actuator pin is controlled by an electromagnetic unit and is loaded in an extension direction by a spring and is fixed in a retracted position opposite from the extension direction by a latching device and at least one latch element of the latching device comprises a ball that is guided for movement in a switching disk in a radial direction relative to the actuator pin and is fixed in a direction perpendicular thereto and is movable into active connection with at least one recess on the at least one actuator pin for locking the actuator pin in position, the latch element is also in active connection with a component that has, on one side, a support surface that is set apart from a base of the recess corresponding to a dimension of the latch element and that has, on the other side, an undercut having a depth that is set apart corresponding to a dimension of the latch element from the outer lateral surface of the actuator pin.

4. The actuator device according to claim 3, wherein a position of at least one of the undercut, of the recesses, or of the latch element in the switching disk in the axial direction of the actuator pin is selected so that the latch elements contact the recesses and the support surface in the retracted position of the actuator pin.

5. The actuator device according to claim 3, wherein the switching disk is connected to at least one transmission pin that is displaceable by the electromagnetic unit against a force of a compression spring in the extension direction.

6. The actuator device according to claim 5, wherein the at least one transmission pin is controlled by a magnetic core arranged within a magnetic coil of the electromagnetic unit.

7. The actuator device according to claim 6, wherein a pressure magnitude of the compression spring is higher than the forces of the spring of the actuator pins.

8. The actuator device according to claim 7, wherein there are two of the actuator pins that are supported with the springs, two of the transmission pins arranged parallel to the actuator pins with respective ones of the compression springs, and the switching disk is located in a guide sleeve and the guide sleeve is attached to a flange.

9. The actuator device according to claim 8, wherein the flange is an abutment for the springs.

* * * * *